US011143140B2

(12) United States Patent
Mastonstråle

(10) Patent No.: US 11,143,140 B2
(45) Date of Patent: Oct. 12, 2021

(54) STIRLING ENGINE COMPRISING A COOLING TUBE ON A WORKING CYLINDER

(71) Applicant: Maston AB, Älvkarleby (SE)

(72) Inventor: Stefan Mastonstråle, Älvkarleby (SE)

(73) Assignee: Maston AB, Älvkarleby (SE)

( * ) Notice: Subject to any disclaimer, the term of this patent is extended or adjusted under 35 U.S.C. 154(b) by 0 days.

(21) Appl. No.: 16/977,424

(22) PCT Filed: Dec. 20, 2018

(86) PCT No.: PCT/SE2018/051357
§ 371 (c)(1),
(2) Date: Sep. 1, 2020

(87) PCT Pub. No.: WO2019/172817
PCT Pub. Date: Sep. 12, 2019

(65) Prior Publication Data

US 2021/0003094 A1 Jan. 7, 2021

(30) Foreign Application Priority Data

Mar. 7, 2018 (SE) ..... 1850247-6

(51) Int. Cl.
*F02G 1/057* (2006.01)
*F02G 1/055* (2006.01)

(52) U.S. Cl.
CPC ..... *F02G 1/057* (2013.01); *F02G 1/055* (2013.01); *F02G 2243/02* (2013.01); *F02G 2244/00* (2013.01); *F02G 2256/04* (2013.01)

(58) Field of Classification Search
CPC ..... F02G 1/057; F02G 1/055; F02G 2243/02; F02G 2244/00; F02G 2256/04; F02G 1/043

(Continued)

(56) References Cited

U.S. PATENT DOCUMENTS 3,577,729 A 5/1971 Warren
4,024,704 A 5/1977 Pinto (Continued)

OTHER PUBLICATIONS

International Search Report for International Application No. PCT/SE2018/051357, dated Feb. 14, 2019 in 3 pages.

*Primary Examiner* — Hoang M Nguyen
(74) *Attorney, Agent, or Firm* — Knobbe, Martens, Olson & Bear, LLP

(57) ABSTRACT

A Stirling engine comprising: a crank case (1) with a crank shaft (2) arranged therein, a displacer cylinder (3) with a reciprocatingly arranged displacer piston (4) therein, said displacer piston (4) being connected to said crank shaft (2) via a connecting rod (5) extending through a first end of said displacer cylinder (3), and wherein the displacer cylinder (3) defines a hot chamber (6) and a cool chamber (7) separated by the displacer piston (4), a working cylinder (8) defining a working cylinder chamber (11) with a reciprocatingly arranged working piston (9) therein, said working piston (9) being connected to said crank shaft (2) via a connecting rod (10) extending through a first end of the working cylinder (8), a heater device (14), arranged at a second end of said displacer cylinder (3) opposite to said first end and configured to heat a working gas which is present in the hot chamber (6) of the displacer cylinder (3) and in fluid communication with the working cylinder chamber (11) through a working gas channel which comprises a first heat exchanger (16) extending from a cylinder head (19) of the displacer cylinder (3) into the heater device (14), a second heat exchanger (17) formed by a regenerator arranged outside the heater device (14), and a transition flow element (22) provided between said second heat exchanger (17) and the working cylinder (8), wherein the Stirling engine also comprises a cooling system for cooling of the displacer cylinder, the working cylinder and the tubular transition flow (Continued)

element. The Stirling engine comprises a first outer tube (30) arranged outside and enclosing the working cylinder (8), and the cooling system comprises a first channel (31) configured to receive a cooling fluid and defined by the outer periphery of the working cylinder (8) and the inner periphery of said first outer tube (30), and said channel (31) covers at least 50% of the outer peripheral surface of the working cylinder (8).

15 Claims, 9 Drawing Sheets

(58) Field of Classification Search
USPC ..... 60/517–526
See application file for complete search history.

(56) References Cited

U.S. PATENT DOCUMENTS

| | | | | |
|---|---|---|---|---|
| 4,455,825 | A | 6/1984 | Hudson | |
| 4,697,420 | A * | 10/1987 | Ishiki | F02G 1/043 60/517 |
| 5,505,047 | A | 4/1996 | Hirose et al. | |
| 7,634,988 | B1 * | 12/2009 | Salminen | F01B 7/18 123/253 |
| 2008/0141921 | A1 * | 6/2008 | Hinderks | F01L 3/02 114/274 |
| 2012/0227389 | A1 * | 9/2012 | Hinderks | F01L 1/146 60/317 |
| 2014/0183025 | A1 * | 7/2014 | Kamen | C02F 1/008 202/185.1 |

* cited by examiner

STIRLING ENGINE COMPRISING A COOLING TUBE ON A WORKING CYLINDER

CROSS-REFERENCE TO RELATED APPLICATIONS

This application is the U.S. National Phase under 35. U.S.C. § 371 of International Application PCT/SE2018/051357, filed Dec. 20, 2018, which claims priority to Swedish Patent Application No. 1850247-6, filed Mar. 7, 2018. The disclosures of the above-described applications are hereby incorporated by reference in their entirety.

TECHNICAL FIELD

The present invention relates to a Stirling engine comprising:

- a crank case with a crank shaft arranged therein,
- a displacer cylinder with a reciprocatingly arranged displacer piston therein, said displacer piston being connected to said crank shaft via a connecting rod extending through a first end of said displacer cylinder, and wherein the displacer cylinder defines a hot chamber and a cool chamber separated by the displacer piston,
- a working cylinder defining a working cylinder chamber with a reciprocatingly arranged working piston therein, said working piston being connected to said crank shaft via a connecting rod extending through a first end of the working cylinder,
- a heater device, arranged at a second end of said displacer cylinder opposite to said first end and configured to heat a working gas which is present in the hot chamber of the displacer cylinder and in fluid communication with the working cylinder chamber through a working gas channel which comprises
- a first heat exchanger extending from a cylinder head of the displacer cylinder into the heater device,
- a second heat exchanger formed by a regenerator arranged outside the heater device, and
- a tubular transition flow element provided between said second heat exchanger and the working cylinder,
- wherein the Stirling engine also comprises a cooling system for cooling of the displacer cylinder, the working cylinder and the tubular transition flow element.

A regenerator is referred to as an internal heat exchanger and temporary heat store placed between the hot chamber of the displacer cylinder and the working cylinder such that the working fluid passes through it first in one direction then the other, taking heat from the fluid in one direction, and returning it in the other. It can be as simple as metal mesh or foam, and benefits from high surface area, high heat capacity, low conductivity and low flow friction. Its function is to retain within the system the heat that would otherwise be exchanged with the environment at temperatures intermediate to the maximum and minimum cycle temperatures.

BACKGROUND ART

External combustion engines of Stirling type are well known. They may be of three different types, which are named alpha, beta and gamma and differ from each other with regard to how the displacer cylinder, the working cylinder and the displacer piston and the working piston are arranged in relation to each other and to the crank shaft that is driven by the working piston.

Essential to the function of a Stirling engine is that a working medium is heated, typically by a burner flame in a combustion chamber. During heating thereof, the working gas is conducted through a heat exchanger that may comprise one or more tubes that extend from the hot chamber of the displacer cylinder into the combustion chamber, and further out of the combustion chamber towards a regenerator. The regenerator is located outside the combustion chamber and is the individual component that distinguishes Stirling engines from other types of external combustion engines. After the regenerator, as seen in a flow direction of the working gas from the hot chamber of the displacer cylinder to the working cylinder, there may also be provided a cooler which is configured to cool the working fluid.

Typically the engine, at least of the gamma type, comprises sealing elements between one or more of the following pairs of components: the crank case and the working cylinder, the working cylinder and a cylinder head arranged on top thereof, said cylinder head and the tubular transition flow element, the displacer cylinder and the crank case, the working piston and the working cylinder, and the displacer piston and the displacer cylinder. During operation of the engine, these sealing element need to be lubricated, and the components to which they belong need to be cooled, in order to maintain a good sealing and prevent leakage of working gas out of the working gas channel. Stirling engines are normally lubricated and cooled by means of lubricating oil present in the crank case. A dry inner atmosphere inside the crank case, free from lubricating and cooling liquid is considered by the present applicant as an alternative to more conventional lubrication and cooling solutions. If such an approach is applied, cooling of the Stirling engine becomes an even more critical issue in order to achieve a functional and reliable engine with no or almost no working gas leakage from the working gas channel.

SUMMARY OF THE INVENTION

It is an object of the present invention to suggest a Stirling engine design that enables the adoption of a dry crank case, i.e. a crank case free from lubricating and cooling liquid, with a cooling system designed with respect thereto. A cooling system that promotes long lasting and reliable sealing of the working gas channel a Stirling engine is thus an object of the invention.

The object of the invention is achieved by means of the initially defined Stirling engine, which is characterised in that it comprises a first outer tube arranged outside and enclosing the working cylinder, and that the cooling system comprises a first channel configured to receive a cooling fluid and defined by the outer periphery of the working channel and the inner periphery of said first outer tube, and that said first channel covers at least 50% of the outer peripheral surface of the working cylinder. According to one aspect, the first channel extends along at least 50% of the length of the working cylinder, preferably along at least 75% of the length of the working cylinder. By means of a large coverage of the outer peripheral surface of the working cylinder by the cooling channel, the duration of working piston sealing elements can be increased. Thereby, the first channel should be configured to enable a cooling fluid to flow from a cooling fluid inlet to said first channel in the region of a first end of the working cylinder to a cooling fluid outlet from the first channel in an opposite second end of the working cylinder. Thanks to the first channel covering a large part of the outer periphery of the working cylinder, sufficient cooling of sealing elements provided between the working piston and the working piston may obtained. Large coverage of the working cylinder periphery also enables efficient cooling that suppresses thermal expansion of the working cylinder that may have detrimental effect on sealing elements between the working cylinder and the crank case as well as on sealing elements provided between the working cylinder and a cylinder head arranged on top of the working cylinder.

According to one aspect said first channel covers at least 75% of the outer peripheral surface of the working cylinder.

According to one aspect, the Stirling engine comprises a second outer tube arranged outside and enclosing the tubular transition flow element, and the cooling system comprises a second channel configured to receive a cooling fluid and defined by the outer periphery of the tubular transition flow element and the inner periphery of said second outer tube, and said second channel covers at least 50% of the outer peripheral surface of the tubular transition element. The transition flow element is a component which forms part of the components that define the working gas channel and is connected to such components. According to one aspect, the transition flow element comprises a tube that in one end is connected to a cylinder head provided on top of the working cylinder, and which in an opposite end is connected to third heat exchanger formed by a cooler via a tube-defining part of the crank case into which said opposite end is inserted and to which said opposite end is connected. Efficient cooling of the transition flow element is vital in order to save the sealing elements provided between the transition flow element and the components to which it is connected from stresses caused by thermal expansion of the transition flow element and thereby to prevent working gas leakage. A large coverage of the outer peripheral surface of the transition flow element also contributes to less thermal stress on the transition flow element itself. The second channel should be configured to enable a cooling fluid to flow from a cooling fluid inlet to said second channel in the region of a first end of the tubular transition flow element to a cooling fluid outlet from the second channel in an opposite second end of the transition flow element. According to one aspect, said second channel covers at least 80% of the outer peripheral surface of the tubular transition element.

According to one aspect, at least a part of the second outer tube is formed by a tube-defining part of the crank case which is remote from the end of an end of the tubular transition element that is connected to a cylinder head provided on top of working cylinder.

According to one aspect, the Stirling engine comprises a cylinder head connected to and arranged on top of the working cylinder, wherein the tubular transition flow element is connected to the cylinder head, wherein the cooling system comprises a third channel provided in the cylinder head, and wherein said third channel interconnects said first channel and said second channel. The cooling system thus defines a cooling circuit which integrates the cooling of the working cylinder, the working cylinder head and the transition flow element. According to one aspect, the engine is a gamma type engine in which the working cylinder and the displacer cylinder have longitudinal axes that are perpendicular to each other. According to one aspect, the transition flow element may then be a tubular element that extends with its longitudinal axis with an angle of 20-40° from the working cylinder top to a further component which defines the working gas channel and which has a longitudinal axis which parallel with the longitudinal axis of the displacer cylinder. According to one aspect, that further component comprises a cooler, configured to actively cool the working gas that flows through it during operation of the engine.

According to one aspect, the working gas channel comprises a third heat exchanger formed by a cooler which is tubular and arranged circumferentially around the displacer cylinder, said cooler being connected in one end to the tubular transition flow element and in another end to the regenerator, and the cooler comprises a third outer tube arranged outside and enclosing a part of the displacer cylinder which is adjacent where the displacer cylinder is connected to the crank case, and the cooling system comprises a fourth channel configured to receive a cooling fluid and defined by the outer periphery of the displacer cylinder and the inner periphery of said third outer tube. According to one aspect, a sealing element is provided at the connection between the crank case and the displacer cylinder. The cooling of the displacer cylinder in the defined region contributes to ensuring less stress on that sealing element. The fourth channel extends circumferentially around the outer periphery of the displacer cylinder and over a length thereof corresponding to the length of the cooler as seen in the longitudinal direction of the displacer cylinder. According to one aspect, the displacer cylinder, carrying sealing elements between itself and the displacer cylinder, is arranged to move through a zone in which the displacer cylinder is thus covered by the fourth channel and cooled by a cooling fluid present therein during operation of the engine.

According to one aspect, the cooler comprises a plurality of separate tubes configured to conduct the working gas, arranged in said fourth channel and extending in the longitudinal direction of the displacer cylinder. The cooling fluid used for cooling the working gas will thus also be used for cooling the displacer cylinder. There is spacing between said tubes of the cooler such that the cooling fluid is able of flowing between the tubes. There is also spacing between the tubes and the outer peripheral surface of the displacer cylinder, enabling the cooling fluid to flow between the set of tubes and the outer peripheral surface of the displacer cylinder.

According to one aspect, the cooling system comprises a first cooling circuit comprising said first channel, said second channel and said third channel, and a second cooling circuit comprising said fourth channel. The first circuit is mainly provided for the purpose of cooling components in order to reduce thermal stresses thereon and to reduce stresses on sealing elements between such components, while the second circuit has the double function of both cooling such a component, the displacer cylinder, and to cool the working gas.

According to one aspect, the cooling system comprises a cooling fluid inlet and a cooling fluid outlet arranged on said third outer tube for separate feed of cooling fluid to and from said fourth channel.

According to one aspect, the cooling system comprises a cooling fluid inlet arranged on said first outer tube at an end thereof corresponding to an end of the working cylinder where the latter is connected to the crank case.

According to one aspect the cooling system comprises a cooling fluid outlet arranged at a further channel that communicates with and forms an extension of said second channel and which is formed in an end of the crank case where the crank case is connected to the displacer cylinder.

According to one aspect, the crank case comprises an opening into which the displacer cylinder extends and through which the connecting rod that connects the displacer cylinder to crank shaft extends, wherein the further channel surrounds said opening.

During operation of the engine, cooling fluid thus flows in a direction from the end of the working cylinder closest to the crank shaft towards and through the cylinder top and further through the second channel in the transition flow element towards the end thereof which is remote from the cylinder head, into the further channel and out through the cooling fluid outlet. According to one aspect, there is provided temperature sensors for measuring the heat of the cooling fluid entering the first channel and for measuring the temperature of the cooling fluid leaving said further channel. The flow rate is controlled on basis of the measured temperatures, whereby the temperature difference is controlled to be within a predetermined range.

According to one aspect, the crank case is free from lubricating liquid, and the engine comprises sealing elements between one or more of the following pairs of components: the crank case and the working cylinder, the working cylinder and a cylinder head arranged on top thereof, said cylinder head and the tubular transition flow element, the displacer cylinder and the crank case, the working piston and the working cylinder, and the displacer piston and the displacer cylinder.

Additional objectives, advantages and novel features of the invention will be apparent to one skilled in the art from the following details, and through exercising the invention. While the invention is described below, it should be apparent that the invention may not be limited to the specifically described details. One skilled in the art, having access to the teachings herein, will recognize additional applications, modifications and incorporations in other areas, which are within the scope of the invention.

BRIEF DESCRIPTION OF THE DRAWINGS

For fuller understanding of the present disclosure and further objects and advantages of it, the detailed description set out below should be read together with the accompanying drawings, in which the same reference notations denote similar items in the various diagrams, and in which.

DETAILED DESCRIPTION

Figure 1:
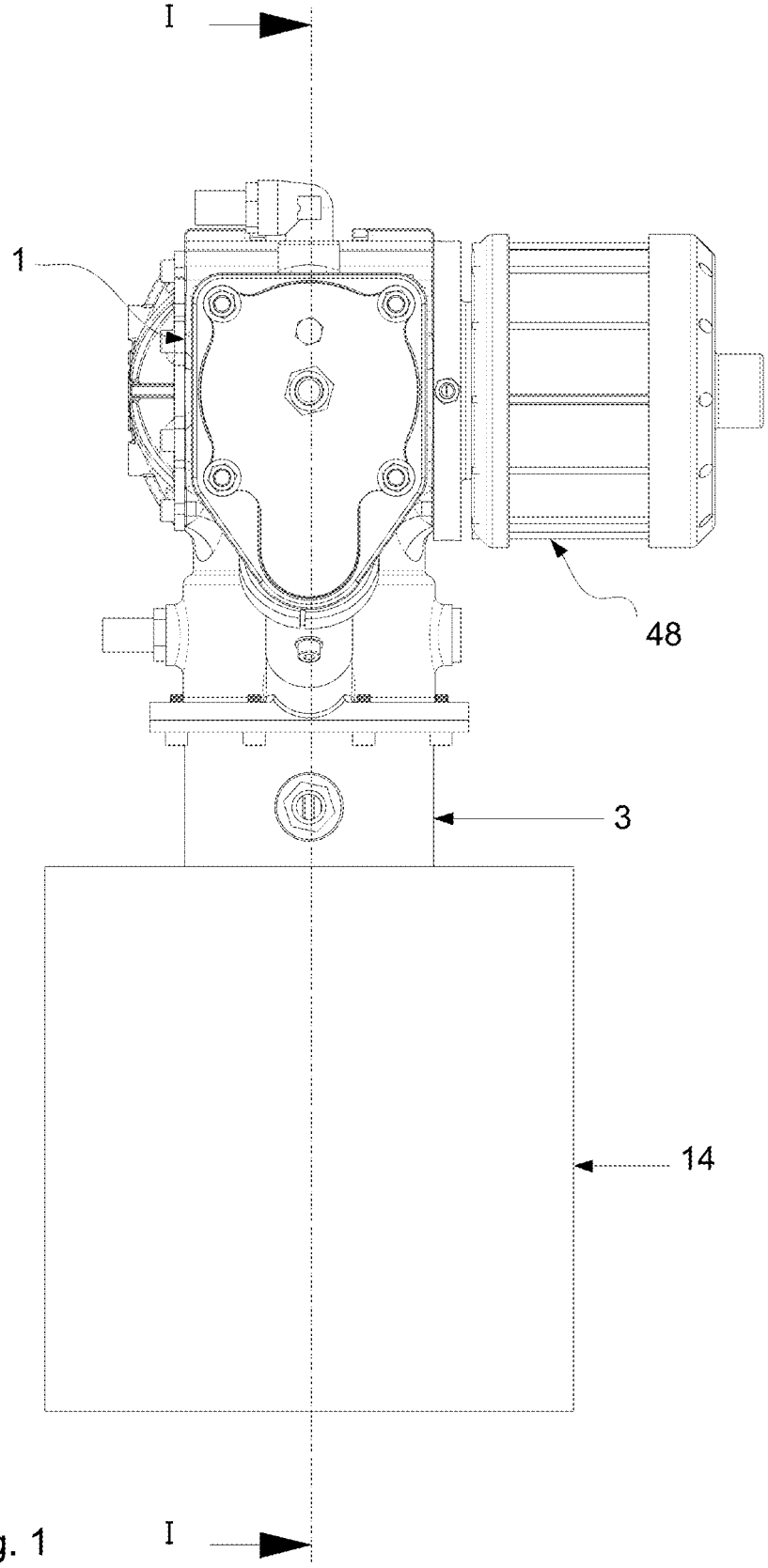
FIG. 1 is a view from above of a Stirling engine according to the example provided with a schematically shown heater device.
Figure 2:
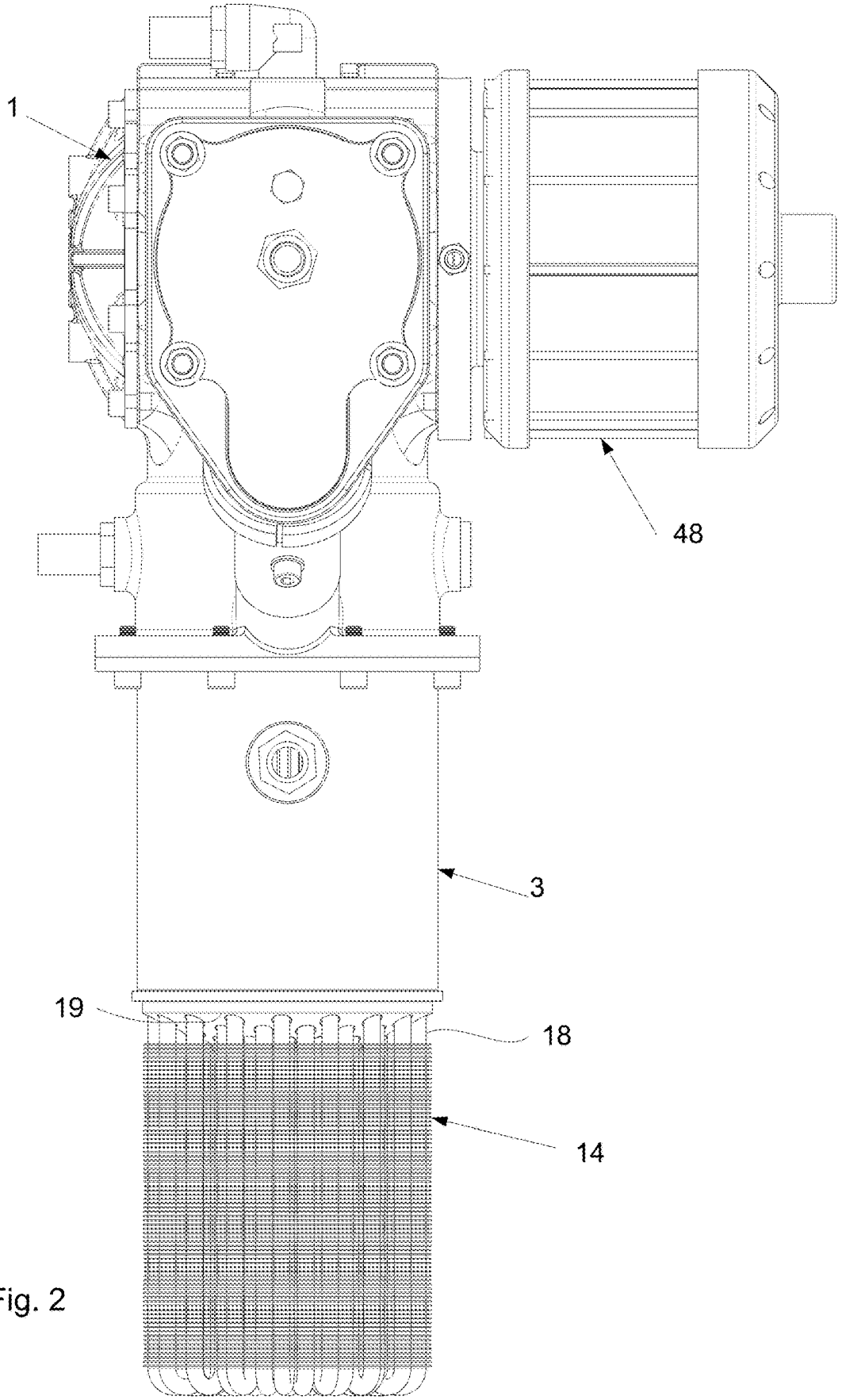
FIG. 2 is a view corresponding to FIG. 1, but with the heater device removed from the rest of the engine.
Figure 3:
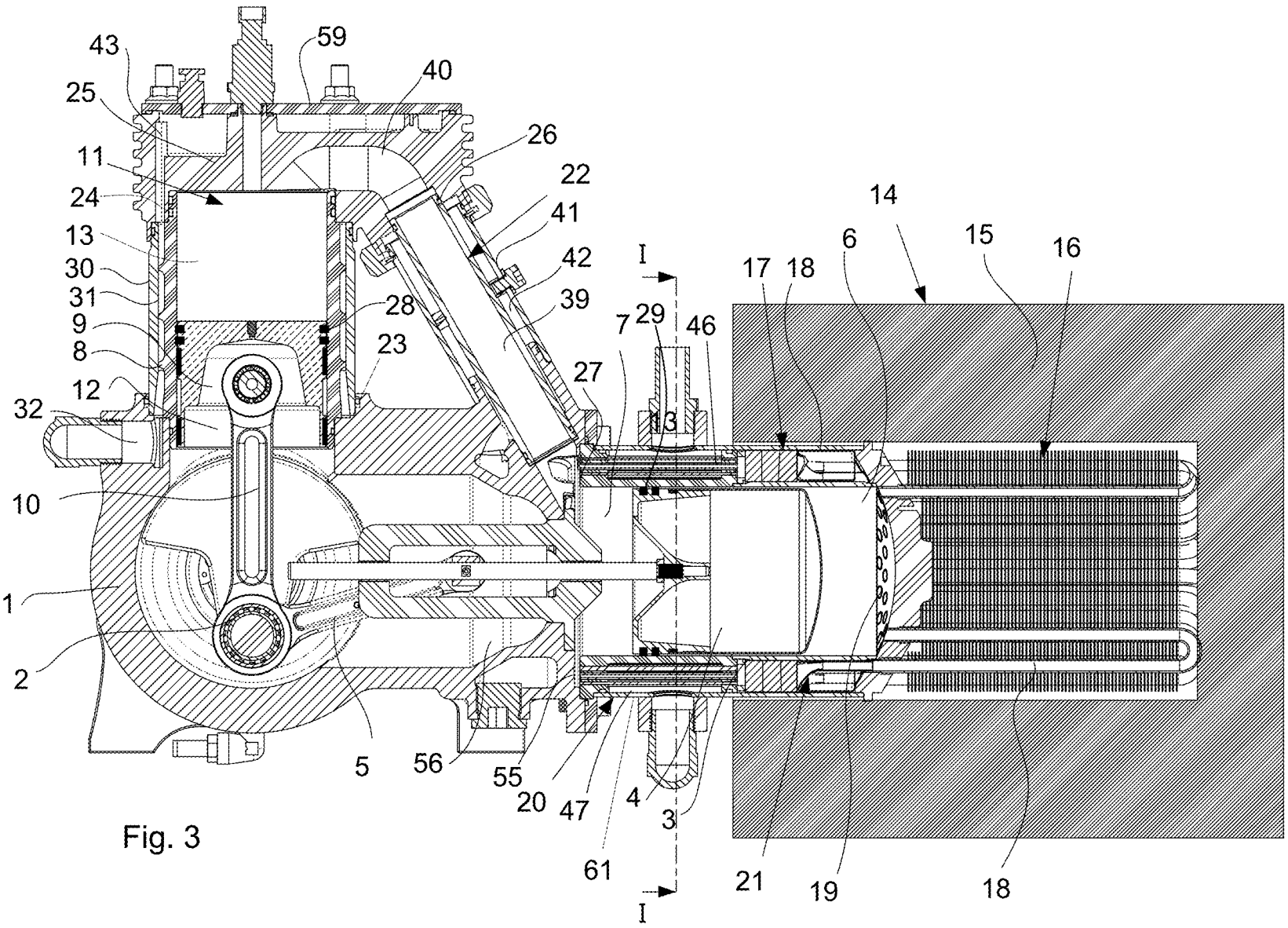
FIG. 3 is a cross-section according to in FIG. 1, still with the heater device shown schematically.
Figure 4:
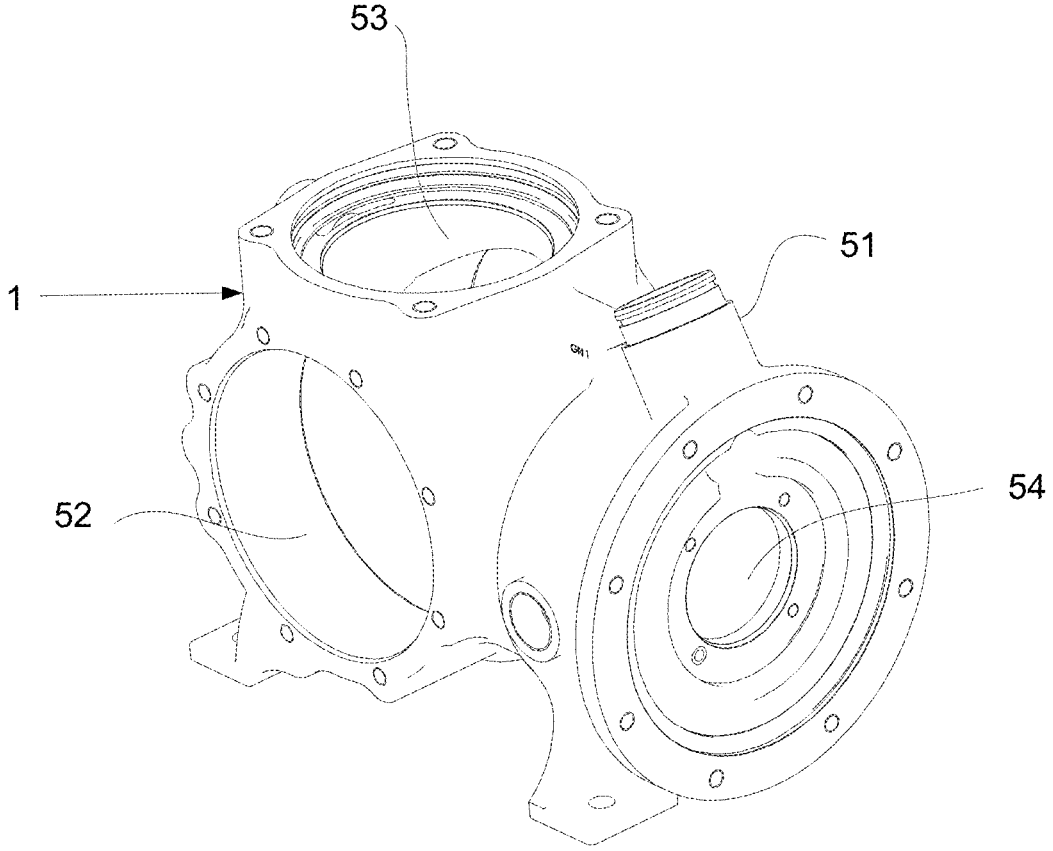
FIG. 4 is a perspective view of the crank case of the Stirling engine shown in FIGS. 1-3.
Figure 5:
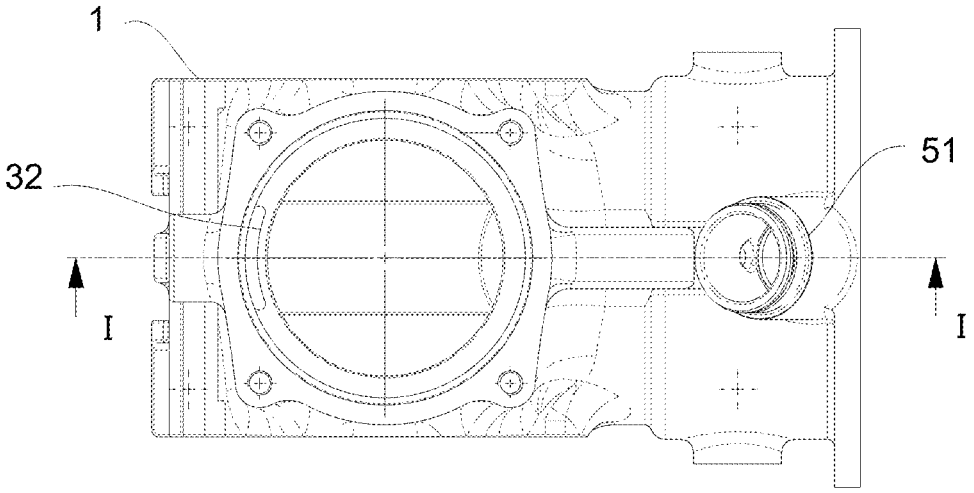
FIG. 5 is a view from above of the crank case shown in FIG. 4.

FIGS. 1-3 show an example of a Stirling engine according to the present disclosure. The Stirling engine shown is of gamma type and comprises a crank case 1 with a crank shaft 2 arranged therein, and a displacer cylinder 3 with a reciprocatingly arranged displacer piston 4 therein. The displacer piston 4 is connected to the crank shaft 2 via a connecting rod 5 extending through a first end of said displacer cylinder 3. During operation of the Stirling engine, the displacer cylinder 3 defines a hot chamber 6 and a cool chamber 7 separated by the displacer piston 4.

The Stirling engine further comprises a working cylinder 8 with a reciprocatingly arranged working piston 9 therein, said working piston 9 being connected to the crank shaft 2 via a connecting rod 10 extending through a first end of the working cylinder 8. A working cylinder chamber 11 defined by the working cylinder 8 is divided by the working piston 9 into a first part 12, through which said connecting rod 10 extends, and a second part 13 configured to house a working gas during operation of the Stirling engine. The second part 13 of the working cylinder chamber 11 is in fluid communication with the hot chamber 6 of the displacer cylinder 3 for the transportation of the working gas between said second part 13 of the working chamber 11 and the hot chamber 6 of the displacer cylinder 3 during operation of the engine.

A heater device 14 is arranged at a second end of the displacer cylinder opposite to said first end and configured to heat a working gas which is present in the hot chamber 6 of the displacer cylinder 3 and which is in fluid communication with the second part 13 of the working cylinder chamber 11. I the example shown the heater device 14 comprises a combustion chamber 15 which is arranged at the second end of said displacer cylinder 3 opposite to said first end.

Furthermore, the Stirling engine comprises a first heat exchanger 16 and a second heat exchanger 17. The first heat exchanger 16 comprises plurality of tubes 18 that extend from a displacer cylinder head 19 provided at said second end of the displacer cylinder 3 into the combustion chamber 15 and out of the combustion chamber 15 to the second heat exchanger 17. The second heat exchanger 17 is comprised by a regenerator provided outside the combustion chamber 15 and outside the displacer cylinder 3. In the example shown the engine also comprises a third heat exchanger 20 formed by a cooler arranged between the regenerator 17 and the working cylinder chamber 11, a transition flow element 21 provided between said first and second heat exchangers 16, 17, and a tubular element 22 provided between the third heat exchanger 20 and the working cylinder 8. The cooler 20 comprises a body with channels 46 defined by tubes 47 for the conduction of the working gas through said body.

To the crank shaft 2 there is connected an electric generator 48, via which electric power can be transferred from the Stirling engine.

The hot chamber 6 defined by the displacer cylinder 3 is in fluid communication with a second end, i.e. the above-defined second part 13, of the working cylinder chamber 11 through a channel comprising the first heat exchanger 16, the second heat exchanger 17, the third heat exchanger 20, the first transition flow element 21 and the tubular element 22.

The crank case 1 is free from lubricating liquid, and the engine comprises sealing elements 23 between the crank case 1 and the working cylinder 8, sealing elements 24 between the working cylinder 8 and the cylinder head 25 arranged on top thereof, sealing elements 26 between said cylinder head 25 and the tubular transition flow element 22, sealing elements 27 between the displacer cylinder 3 and the crank case 1, sealing elements 28 between the working piston 9 and the working cylinder 8, and sealing elements 29 between the displacer piston 4 and the displacer cylinder 3. The sealing elements 23-29 are configured to prevent or at least control leakage of working gas between the components between which they form sealing. They comprise bodies of material that will be physically affected by heat fluctuations in the engine as well as mechanically affected by thermal expansion of the components between which they form said sealing.

The Stirling engine further comprises a cooling system for cooling of the displacer cylinder 3, the working cylinder 8 and the tubular transition flow element 22. The cooling system comprises a first outer tube 30 arranged outside and enclosing the working cylinder 8. A first channel 31 configured to receive a cooling fluid is defined by the outer periphery of the working cylinder 8 and the inner periphery of said first outer tube 30, wherein said channel 31 covers more than 75% of the outer peripheral surface of the working cylinder 8. There is provided a cooling fluid inlet 32 in the crank case 1 which communicates with said first channel 31 and through which a cooling fluid, preferably water, is introduced, preferably pumped by means of a pump, into said first channel 31 during operation of the engine.

With reference to FIGS. 13-16 the working cylinder 8 is further shown in detail. The working cylinder 8 comprises circumferential ridges 33, 34, 35 on its outer periphery. The outer edge of each ridge 33, 34, 35 is in contact with the first outer tube 30 (see FIG. 3) such that the first outer tube 30 will contribute to the mechanical strength of the working cylinder 8 and improve the ability of the latter to withstand the mechanical stresses which it is subjected to during operation of the engine, and will thereby indirectly contribute to the overall object of the present disclosure to ensure good sealing of the working gas channel. Each ridge 33, 34, 35 has an opening 36, 37, 38 therein that enables the cooling fluid to pass it in the longitudinal direction, from a region of the bottom of the working cylinder 8 to a region of the top of the working cylinder 8 where the latter is connected to the cylinder head 25.

An upper end of the working cylinder 8 is connected to the cylinder head 25, wherein the end of the working cylinder 8 protrudes into an opening in the cylinder head 25. The second part 13 of the working cylinder chamber 11 communicates with a channel 39 defined by the tubular transition flow element 22 through a channel 40 provided in the cylinder head 25.

The cooling system also comprises a second outer tube 41 arranged outside and enclosing the tubular transition flow element 22, thereby defining a second channel 42 of the cooling system which is configured to receive a cooling fluid and defined by the outer periphery of the tubular transition flow element 22 and the inner periphery of said second outer tube 41. The second channel 42 covers at least 75% of the outer peripheral surface of the tubular transition element 22.

The tubular transition flow element is connected to the cylinder head, and the cooling system comprises a third channel 43 provided in the cylinder head 25, wherein said third channel 43 interconnects said first channel 31 and said second channel 42. With reference to FIGS. 3 and 8-12 the design of said third channel 43 of the cooling system will now be described. As can be seen in FIG. 3 and in FIG. 9, the third channel 43 comprises a first part 44, which is provided in an end of the cylinder head 25 which is opposite to the end in which the cylinder head is connected to the tubular transition flow element 22. The first part 44 of the third channel extends from said first channel 31 in the longitudinal direction of working cylinder 8 to an upper part of the cylinder head 25 where it expands into a second part 45 of the third channel 43. The second 45 part of the third channel 43 is formed by a cavity in an upper part of the cylinder head 25 that extends from a first end of the cylinder head 25 where the first part 44 of the third channel 43 is located to an opposite second end thereof, in which the cylinder head 25 is connected to the tubular transition flow element 22. In said second end of the cylinder head 25, a third part 49, 50 of the third channel 43 is formed by two sub-channels 46, 47 that extend from said cavity on opposite sides of the working gas channel 40 which extends through the cylinder head 25 to the channel 39 defined by the tubular transition flow element 22. The sub-channels 49, 50 ends up in a ring-shaped channel that encircles an end of the tubular transition flow element 22 and which thereby transforms into the above-defined second channel 42 of the cooling system. In FIGS. 8-12, the cylinder head 25 is shown without a top 59, which, when mounted, forms a lid on top of the cylinder head that separates said cavity from the surrounding environment, see FIG. 3.

The second channel 42 of the cooling system extends to an end of the tubular transition flow element 22 in which the latter is connected to and encircled by a tube-defining part 51 of the crank case 1. The tube-defining part 51 of the crank case may be regarded as a part of the second outer tube 41 that encloses the tubular transition flow element 22 and thereby defines the second channel 42. The second channel 42 is thus also defined by the outer periphery of the tubular transition flow element 22 and an inner periphery of said tube defining part 51 of the crank case 1, into which an end of the tubular transition flow element extends.

The crank case 1 will now be described more in detail with reference to FIGS. 3 and 4-7. The crank case 1 is a hollow body that presents a first opening 52 via which the crank-shaft 2 is connected to the electric generator 48, a second opening 53 into which an end of the working cylinder 8 extends and via which the connecting rod 10 of the working piston 9 is connected to the crank shaft 2, and a third opening into which the displacer cylinder 3 extends and via which the connecting rod 5 of the displacer piston is connected to the crank shaft 2. The first, second and third openings 52, 52 and 54 have a respective centre axis which are perpendicular to each other. The third opening 54 also receives and end of the cooler 20 and the working gas-containing channels 46 end in a circular recess 55 in the crank case 1 in the region of the third opening 54, which circular recess communicates with the channel 39 inside the tubular transition flow element 22 (see FIG. 3), thereby enabling the working gas to flow from the cooler 20 into the channel 39 defined by the tubular transition flow element 22 as well as in the opposite direction.

Figure 6:
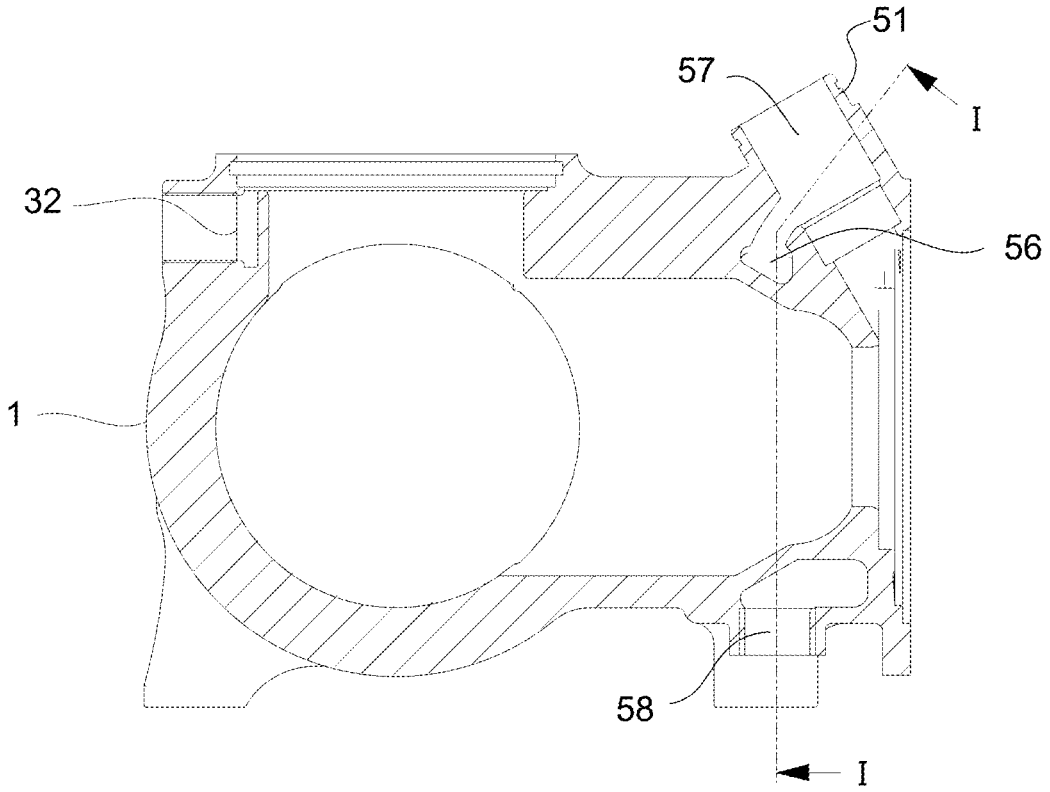
FIG. 6 is a cross-section according to I-I in FIG. 5.
Figure 7:
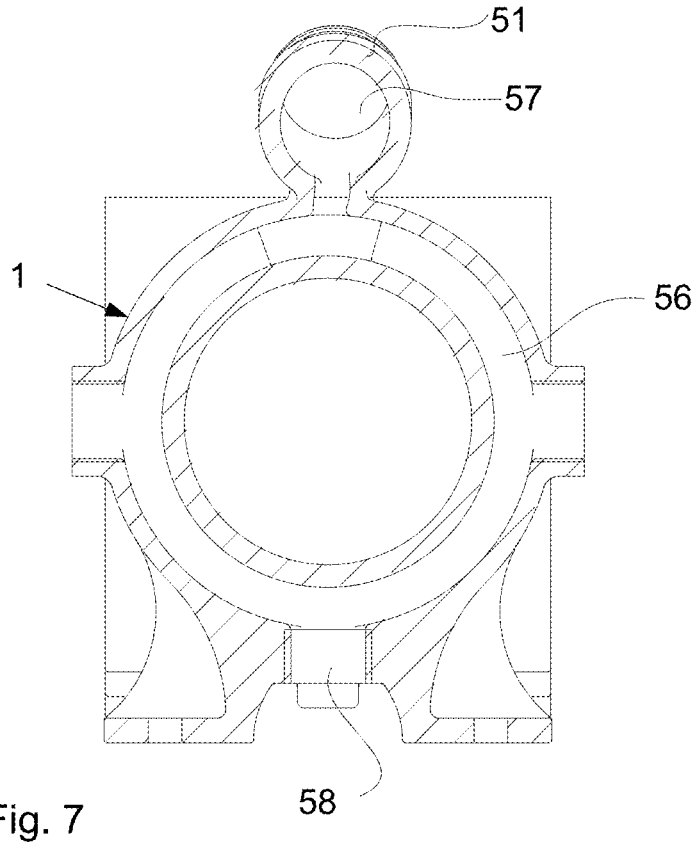
FIG. 7 is a cross-section according to I-I in FIG. 6.
Figure 8:
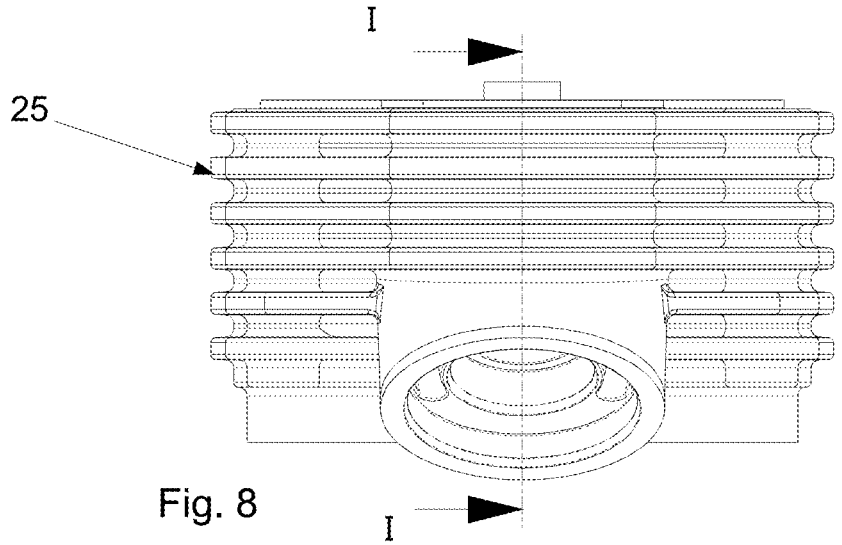
FIG. 8 is a side view of a working cylinder head of the Stirling engine shown in FIGS. 1-3.
Figure 9:
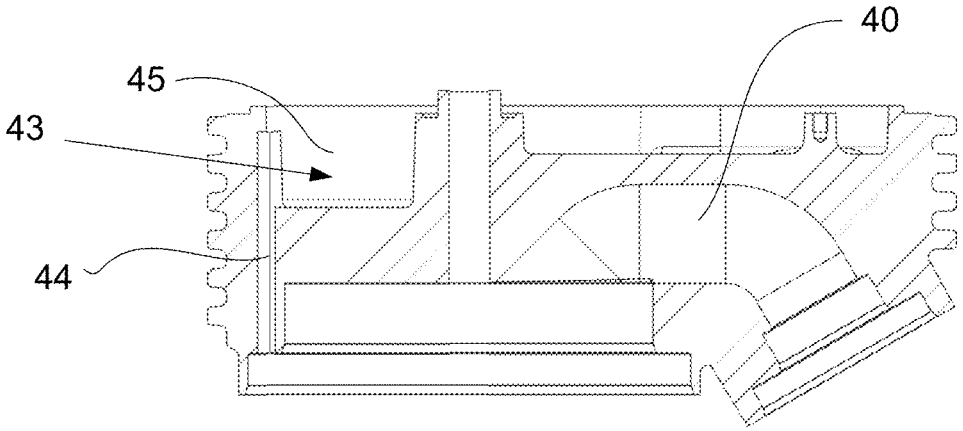
FIG. 9 is a cross-section according to I-I in FIG. 8.
Figure 10:
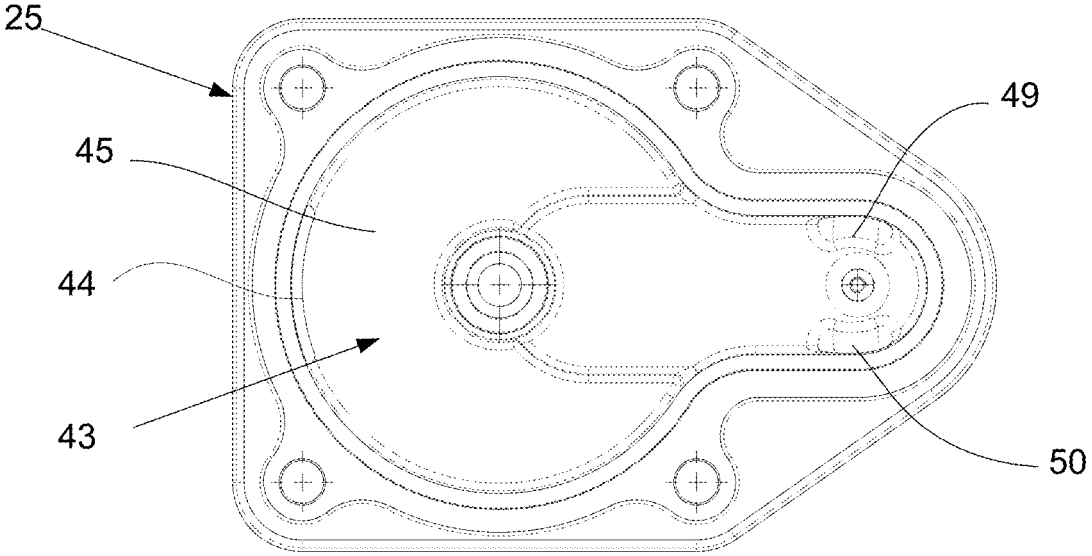
FIG. 10 is a view from above of the working cylinder head shown in FIG. 8, with a top removed.
Figure 11:
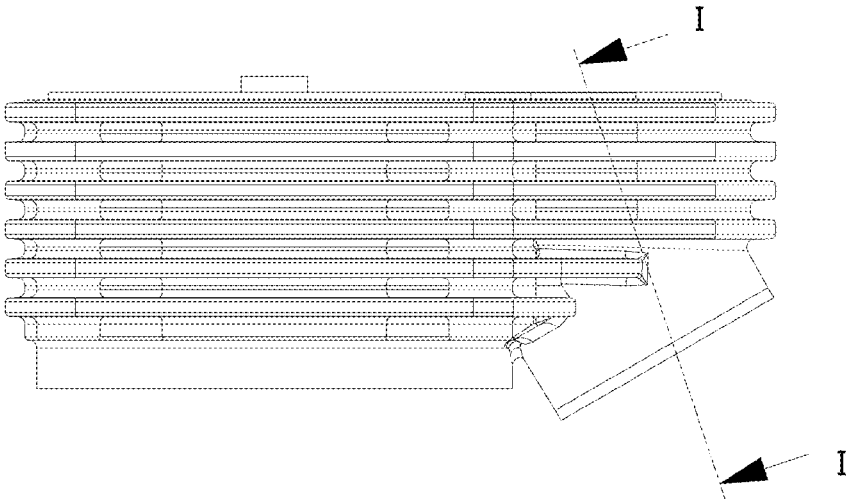
FIG. 11 is a side view of the working cylinder head, turned 90° compared to FIG. 8.
Figure 12:
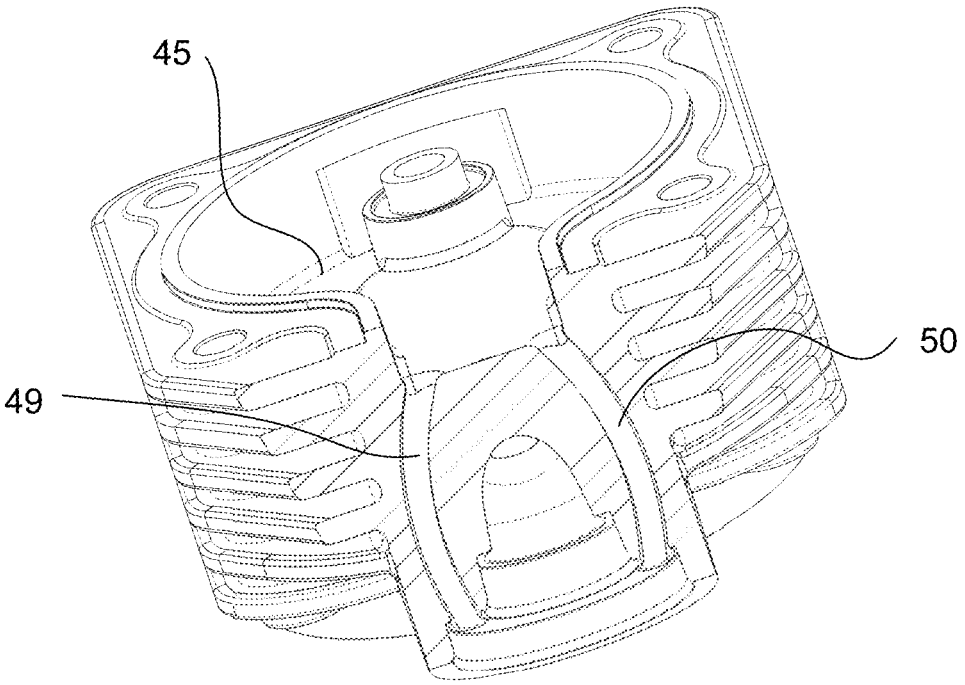
FIG. 12 is a cross-section according to I-I in FIG. 11.
Figure 13:
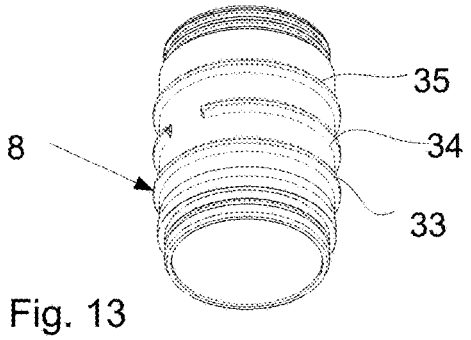
FIG. 13 is a perspective view of the working cylinder of the Stirling engine shown in FIGS. 1-3.
Figure 14:
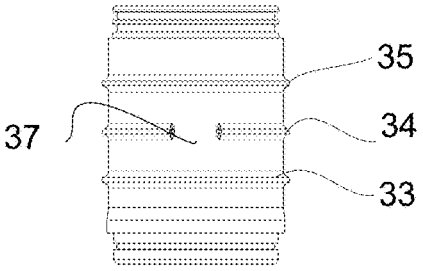
FIG. 14 is a side view of the working cylinder shown in FIG. 13 from a first direction.
Figure 15:
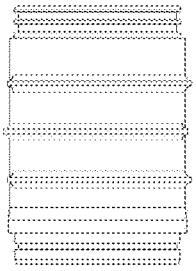
FIG. 15 is a side view of the working cylinder shown in FIG. 13 from a second direction, 90° from the first direction.
Figure 16:
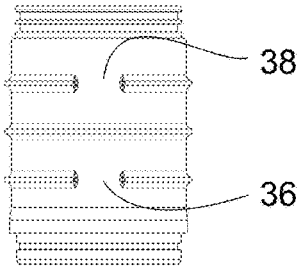
FIG. 16 is a side view of the working cylinder shown in FIG. 13 from a third direction, 180° from the first direction.

As can be seen in FIGS. 6 and 7, the crank case 1 comprises a channel 56 that communicates with and forms an extension of said second channel 42 and which is formed in an end of the crank case 1 in the region of said third opening 54 therein. The channel 56 is an annular channel having an inlet in an upper region thereof were it communicates with a channel 57 defined by the tube-defining part 51 of the crank case 1, inside which the tubular transition flow element 22 is arranged. Accordingly, the annular channel 56 forms an extension of said second channel 42 which is formed between an inner periphery of the tube-defining part 51 of the crank case 1 and an outer periphery of the tubular transition flow element 22, and which surrounds said fourth opening 54 of the crank case 1. At a bottom region of the crank case 1, opposite to where the annular channel 56 meets said second channel 42, there is provided a cooling fluid outlet 58 through which the cooling fluid is enabled to exit from the annular channel 56.

The first channel 31, the second channel 42, the third channel 43 and the extension of the second channel 42 formed by the annular channel 56 forms a separate cooling circuit in which a cooling fluid is introduced into the cooling fluid inlet 32, conducted through said channels in the above-mentioned order and exits through the cooling fluid outlet 58. Preferably, a pump, not shown is used for pumping the cooling fluid through said cooling circuit, which preferably is a closed circuit. The flow rate of the cooling fluid, i.e. the output of the pump, is controlled as a response to the temperature difference between cooling fluid introduced at the cooling fluid inlet 32 and the cooling fluid that exits through the cooling fluid outlet, and/or the temperature of the cooling fluid that exits through the cooling fluid outlet 58. In FIG. 3, plugs are inserted in the cooling fluid inlet 32 and the cooling fluid outlet 58. However, it should be understood that such plugs are removed when the engine is provided with said pump and hoses leading from the inlet and the outlet to said pump.

Figure 17:
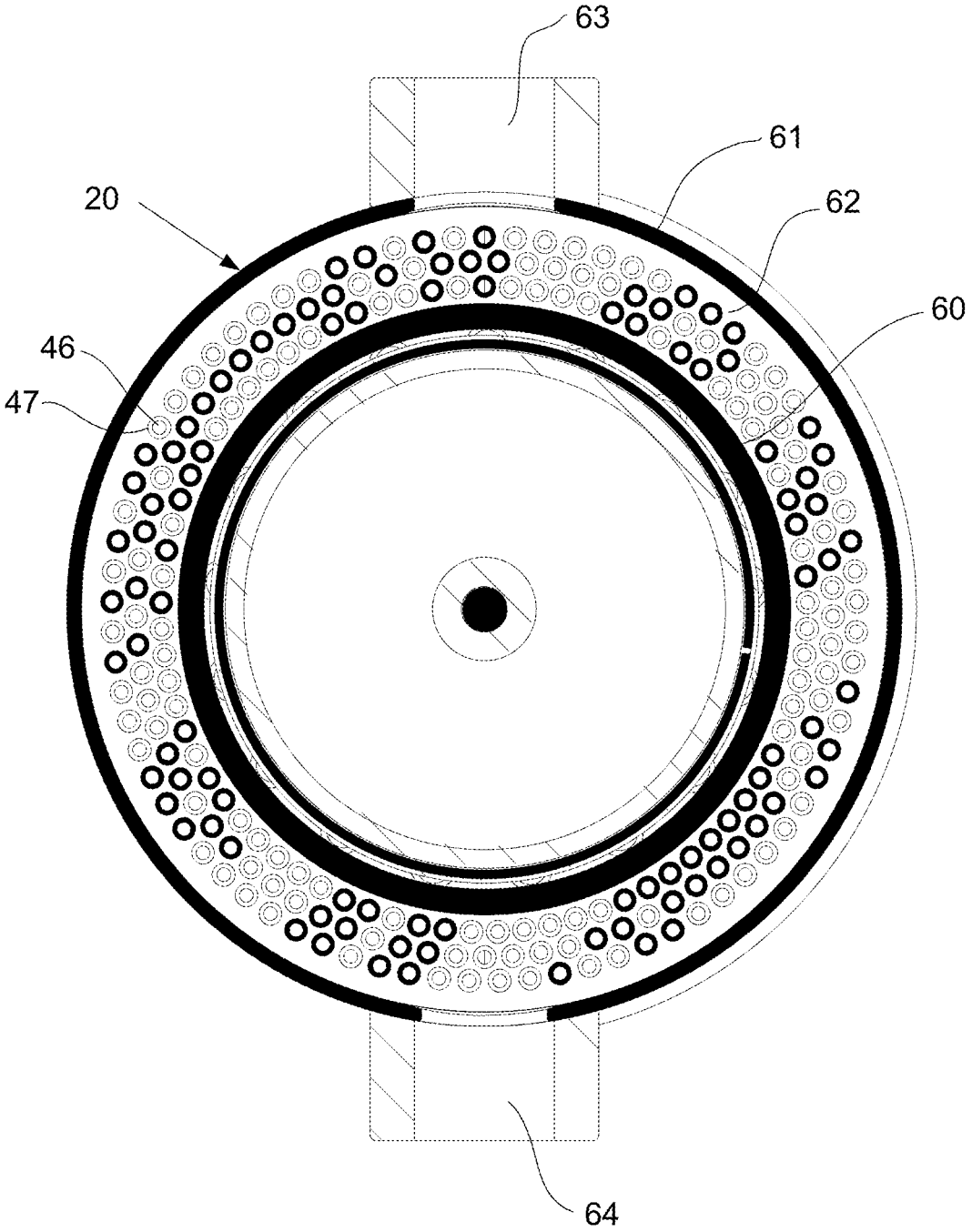
FIG. 17 is a cross-section according to I-I in FIG. 3.

With reference to FIGS. 3 and 17, the cooler 20 and a part of the cooling system related thereto will now be described more in detail. The cooler 20 is tubular and arranged circumferentially around the displacer cylinder 3, said cooler 20 being connected in one end to the tubular transition flow element 22 via a part of the crank case 1 in which the circular recess 55 is provided and in another end to the regenerator 17. The cooler comprises an inner tube 60 that forms part of the displacer cylinder 3 and a third outer tube 61 of the cooling system that is arranged outside and enclosing a part of the displacer cylinder 3 which is adjacent where the displacer cylinder 3 is connected to the crank case 1. As a result thereof, the cooling system comprises a fourth channel 62 configured to receive a cooling fluid and defined by the outer periphery of the displacer cylinder 3 and the inner periphery of said third outer tube 61.

The cooler 20 further comprises a cooling fluid inlet 63 and a cooling fluid outlet provided 64 provided in the outer tube 61. In the example shown, the inlet is 63 arranged at a top side of the cooler 20, as seen when the engine stands on a horizontal plane in a operation position, and the cooling fluid outlet 64 is arranged at an opposite bottom side of the cooler 20. The inlet 63 and the outlet 64 are preferably connected to a cooling fluid pump arranged to pump fluid into the fourth channel 62 via said inlet 63, through the fourth channel 62, and out of the fourth channel via the outlet 64. Accordingly the engine comprises a separate and closed cooling circuit thereby provided for the cooling of the working gas flowing through the channels 46 formed by the tubes 47 and for simultaneously cooling the inner tube 60 of the cooler 20 that forms part of the displacer cylinder 20.

According to an example, the Stirling engine comprising: a crank case with a crank shaft arranged therein, a displacer cylinder with a reciprocatingly arranged displacer piston therein, said displacer piston being connected to said crank shaft via a connecting rod extending through a first end of said displacer cylinder, and wherein the displacer cylinder defines a hot chamber and a cool chamber separated by the displacer piston, a working cylinder defining a working cylinder chamber with a reciprocatingly arranged working piston therein, said working piston being connected to said crank shaft via a connecting rod extending through a first end of the working cylinder, a heater device, arranged at a second end of said displacer cylinder opposite to said first end and configured to heat a working gas which is present in the hot chamber of the displacer cylinder and in fluid communication with the working cylinder chamber through a working gas channel which comprises a first heat exchanger extending from a cylinder head of the displacer cylinder into the heater device, a second heat exchanger formed by a regenerator arranged outside the heater device, and a tubular transition flow element provided between said second heat exchanger and the working cylinder, wherein the Stirling engine also comprises a cooling system for cooling of the displacer cylinder, the working cylinder and the tubular transition flow element, said Stirling engine comprises a first outer tube arranged outside and enclosing the working cylinder, and that the cooling system comprises a first channel configured to receive a cooling fluid and defined by the outer periphery of the working cylinder and the inner periphery of said first outer tube, and that said channel covers at least 50% of the outer peripheral surface of the working cylinder.

According to this example, the transition flow element is provided between the second heat exchanger and the working cylinder. The tubular transition flow element is according to this example a tubular element, which comprises a flow in transition. The tubular transition flow element is a part of a working gas channel. The working gas is in transition in the tubular transition flow element provided between the second heat exchanger and the working cylinder.

The foregoing description of the examples has been furnished for illustrative and descriptive purposes. It is not intended to be exhaustive, or to limit the examples to the variants described. Many modifications and variations will obviously be apparent to one skilled in the art. The examples have been chosen and described in order to best explicate principles and practical applications, and to thereby enable one skilled in the art to understand the examples in terms of its various examples and with the various modifications that are applicable to its intended use. The components and features specified above may, within the framework of the examples, be combined between different examples specified.

What is claimed is:

1. A Stirling engine comprising:

a crank case with a crank shaft arranged therein, a displacer cylinder with a reciprocatingly arranged displacer piston therein, said displacer piston being connected to said crank shaft via a connecting rod extending through a first end of said displacer cylinder, and wherein the displacer cylinder defines a hot chamber and a cool chamber separated by the displacer piston, a working cylinder defining a working cylinder chamber with a reciprocatingly arranged working piston therein, said working piston being connected to said crank shaft via a connecting rod extending through a first end of the working cylinder, a heater device, arranged at a second end of said displacer cylinder opposite to said first end and configured to heat a working gas which is present in the hot chamber of the displacer cylinder and in fluid communication with the working cylinder chamber through a working gas channel which comprises a first heat exchanger extending from a cylinder head of the displacer cylinder into the heater device, a second heat exchanger formed by a regenerator arranged outside the heater device, and a transition flow element provided between said second heat exchanger and the working cylinder, wherein the Stirling engine also comprises:

a cooling system for cooling of the displacer cylinder, the working cylinder, the tubular transition flow element, and a first outer tube arranged outside and enclosing the working cylinder, wherein the cooling system comprises a first channel configured to receive a cooling fluid and defined by the outer periphery of the working cylinder and the inner periphery of said first outer tube, and wherein said channel covers at least 50% of the outer peripheral surface of the working cylinder.

2. The Stirling engine according to claim 1, wherein said first channel covers at least 75% of the outer peripheral surface of the working cylinder.

3. The Stirling engine according to claim 1, further comprising a second outer tube arranged outside and enclosing the tubular transition flow element, wherein the cooling system comprises a second channel configured to receive a cooling fluid and defined by the outer periphery of the tubular transition flow element and the inner periphery of said second outer tube, and wherein said second channel covers at least 50% of the outer peripheral surface of the tubular transition element.

4. The Stirling engine according to claim 3, wherein said second channel covers at least 80% of the outer peripheral surface of the tubular transition element.

5. The Stirling engine according to claim 3, wherein at least a part of the second outer tube is formed by a tube-defining part of the crank case which is remote from an end of the tubular transition element that is connected to a cylinder head provided on top of working cylinder.

6. The Stirling engine according to claim 1 further comprising a cylinder head connected to and arranged on top of the working cylinder, wherein the tubular transition flow element is connected to the cylinder head, wherein the cooling system comprises a third channel provided in the cylinder head, and wherein said third channel interconnects said first channel and said second channel.

7. The Stirling engine according to claim 1, wherein the working gas channel comprises a third heat exchanger formed by a cooler which is tubular and arranged circumferentially around the displacer cylinder, said cooler being connected in one end to the tubular transition flow element and in another end to the regenerator, wherein the cooler comprises a third outer tube arranged outside and enclosing a part of the displacer cylinder which is adjacent where the displacer cylinder is connected to the crank case (1), and wherein the cooling system comprises a fourth channel configured to receive a cooling fluid and defined by the outer periphery of the displacer cylinder and the inner periphery of said third outer tube.

8. The Stirling engine according to claim 7, wherein the cooler comprises a plurality of separate tubes configured to conduct the working gas, arranged in said fourth channel and extending in the longitudinal direction of the displacer cylinder.

9. The Stirling engine according to claim 1, wherein the cooling system comprises a first cooling circuit comprising said first channel, said second channel and said third channel, and a second cooling circuit comprising said fourth channel.

10. The Stirling engine according to claim 7, wherein the cooling system comprises a cooling fluid inlet and a cooling fluid outlet arranged on said third outer tube for separate feed of cooling fluid to and from said fourth channel.

11. The Stirling engine according to claim 1, wherein the cooling system comprises a cooling fluid inlet arranged on said first outer tube at an end thereof corresponding to an end of the working cylinder where the latter is connected to the crank case.

12. The Stirling engine according to claim 1 further comprising a cooling fluid outlet arranged at a further channel that communicates with and forms an extension of said second channel and which further channel is formed in an end of the crank case where the crank case is connected to the displacer cylinder.

13. The Stirling engine according to claim 12, wherein the crank case comprises an opening into which the displacer cylinder extends and through which the connecting rod that connects the displacer piston to the crank shaft extends, and wherein the further channel surrounds said opening.

14. The Stirling engine according to claim 1, wherein the crank case is free from lubricating liquid, and wherein the engine comprises sealing elements between one or more of the following pairs of components: the crank case and the working cylinder, the working cylinder and a cylinder head arranged on top thereof, said cylinder head and the tubular transition flow element, the displacer cylinder and the crank case, the working piston and the working cylinder, and the displacer piston and the displacer cylinder.

15. The Stirling engine according to claim 9, wherein the cooling system comprises a cooling fluid inlet and a cooling fluid outlet arranged on said third outer tube for separate feed of cooling fluid to and from said fourth channel.

* * * * *